United States Patent [19]

Brook et al.

[11] 4,067,752

[45] Jan. 10, 1978

[54] AUSTENITIC AGING OF METALLIC COMPOSITIONS

[75] Inventors: Greville B. Brook, Bucks, England; Peter L. Brooks, Palo Alto; Roger F. Iles, Foster City, both of Calif.

[73] Assignee: Raychem Corporation, Menlo Park, Calif.

[21] Appl. No.: 550,556

[22] Filed: Feb. 18, 1975

Related U.S. Application Data

[63] Continuation-in-part of Ser. No. 417,067, Nov. 19, 1973, abandoned.

[51] Int. Cl.[2] ..... C22C 9/01; C22C 9/04; C22F 1/08

[52] U.S. Cl. ..... 148/11.5 R; 75/157.5; 148/11.5 C; 148/32; 148/32.5

[58] Field of Search ..... 148/11.5 R, 32, 32.5, 148/11.5 C; 75/157.5

[56] References Cited

U.S. PATENT DOCUMENTS

| | | | |
|---|---|---|---|
| 3,567,523 | 3/1971 | Jackson et al. | 148/11.5 R |
| 3,748,197 | 7/1973 | Willson et al. | 148/131 |
| 3,783,037 | 1/1974 | Brook et al. | 148/11.5 R |
| 3,802,930 | 4/1974 | Brook et al. | 148/11.5 R |

*Primary Examiner*—W. Stallard
*Attorney, Agent, or Firm*—Lyon & Lyon

[57] ABSTRACT

Some metallic compositions that undergo a reversible transformation between austenitic and martensitic states as a result of being heated or cooled through critical temperature ranges may lose a portion or all of the ability to revert from martensite to austenite. That loss can be inhibited by "aging" the composition prior to its conversion to the martensitic state by holding it at a temperature at which it exists in the austenitic state. The time required to significantly inhibit loss of reversibility may vary as the nature of the composition changes. For a specific composition, the time required typically is shortened as the holding temperature is raised.

The ability of a composition to respond to preconditioning methods by which its $A_s$ temperature can be elevated may also be improved by aging in the austenitic state prior to attempting preconditioning.

22 Claims, 5 Drawing Figures

COPPER - ALUMINUM - ZINC (BALANCE) ALLOYS
COMPOSITION VERSUS FIGURE OF MERIT
AGED SAMPLES
100 C SLOW HEATING LIMIT
WEIGHT PERCENT ALUMINUM
WEIGHT PER CENT COPPER
40
20
6
5
4
3
2
66
67
68
69
70
71
72

AUSTENITIC AGING OF METALLIC COMPOSITIONS

RELATED APPLICATIONS

This application is a continuation-in-part of application Ser. No. 417,067 filed Nov. 19, 1973 and now abandoned.

FIELD OF THE INVENTION

This invention relates to metallic compositions that undergo reversible austenitic-martensitic transformations.

BACKGROUND OF THE INVENTION

Metallic compositions which that are known to be capable of undergoing a reversible transformation from the austenitic state to the martensitic state include unalloyed metals but this phenomenon is most commonly exhibited by alloys. Such alloys include, for example, those disclosed in U.S. Pat. Nos. 3,012,882; 3,174,851; 3,351,463; 3,567,523; 3,753,700; and 3,759,552, Belgian Pat. No. 703,649 and in British patent application Nos. 22372/69, 55481/69, 55482/69, 55959/69 and 53734/70 (now British Pat. Nos. 1,315,652; 1,315,653; 1,346,046 and 1,346,047) in the name of the Fulmer Research Institute. The disclosure of each of the aforementioned patents and applications is incorporated herein by reference.

Such alloys are also disclosed in NASA Publication SP5110, "55-Nitinol-the alloy with a memory, etc." (U.S. Government Printing Office, Washington, D.C., 1972), N. Nakanishi et al, Scripta Metallurgica 5, 433–440 (Pergamon Press 1971), the disclosures of which are likewise incorporated herein by reference.

These, and other alloys, have in common the feature of undergoing a shear transformation on cooling from a relatively high temperature (austenitic) state to a low temperature (or martensitic) state. If an article made of such an alloy is deformed when in its martensitic state it will remain so deformed. If it is heated to return it to a temperature at which it is austenitic, it will tend to return to its undeformed state. The transition from one state to the other, in each direction, takes place over a temperature range. The temperature at which martensite starts to form on cooling is designated $M_s$ while the temperature at which this process is complete is designated $M_f$, each of these temperatures being those achieved at high, e.g., 100° C per minute, rates of change of temperature of the sample. Similarly, the temperature of the beginning and end of the transformation to austenite are designated $A_s$ and $A_f$, respectively. Generally, $M_f$ is a lower temperature than $A_s$, $M_s$ is a lower temperature than $A_f$, and $M_s$ can be lower, equal to or higher than $A_s$, for a given alloy depending on composition and thermomechanical history. The transformation from one form to the other may be followed by measuring one of a number of physical properties of the material in addition to the reversal of deformation described above, for example, its electrical resistivity, which shows an anomaly as the transformations take place. If graphs of resistivity-v-temperature or strain-v-temperature are plotted, a line joining the points $M_s$, $M_f$, $A_s$, $A_f$ and back to $M_s$ forms a loop termed the hysteresis loop (see FIG. 3). For many materials $M_s$ and $A_s$ are at approximately the same temperature.

One particularly useful alloy possessing heat recoverability or shape memory is the intermetallic compound TiNi, as described in U.S. Pat. No. 3,174,851. The temperature at which deformed objects of the alloys return to their original shape depends on the alloy composition as disclosed in British Pat. No. 1,202,404 and U.S. Pat. No. 3,753,700, e.g., the recovery of original shape can be made to occur below, at, or above room temperature.

In certain commercial applications employing heat recoverable alloys, it is desirable that $A_s$ be at a higher temperature than $M_s$, for the following reason. Many articles constructed from such alloys are provided to users in a deformed condition and thus in the martensitic state. For example, couplings for hydraulic components, as disclosed in U.S. patent applications Ser. Nos. 852,722 filed Aug. 25, 1969 and 51809 filed July 2, 1970 (British Pat. Nos. 1,327,441 and 1,327,442), are sold in a deformed (i.e., an expanded) state. The customer places the expanded coupling over the components (for example, the ends of hydraulic pipe lines) to be joined and raises the temperature of the coupling. As its temperature reaches the austenitic transformation range, the coupling returns, or attempts to return, to its original configuration, and shrinks onto the components to be joined. Because it is necessary that the coupling remain in its austenitic state during use (for example, to avoid stress relaxation which occurs during the martensitic transformation and because its mechanical properties are superior in the austenitic state), the $M_s$ of the material is chosen so as to be below the lowest temperature which it may possibly reach in service. Thus, after recovery, during service the material will remain at all times in the austenitic state. For this reason, once deformed it has to be kept in, for example, liquid nitrogen until it is used. If, however, the $A_s$ ($A_s$, as used herein, means that temperature which marks the beginning of a continuous sigmoidal transition as plotted on a strain vs. temperature graph, to the austenitic state of all the martensite capable of undergoing that transformation) could be raised, if only temporarily for one heating cycle, without a corresponding rise in the $M_s$ then the expanded coupling could be maintained at a higher and more convenient temperature. The advantage this would provide is an obvious one. For example, if the $A_s$ of the alloy from which it is made could be raised sufficiently to allow the coupling to be handled at ambient temperature without recovery occuring, it would be possible to avoid the problems and expense associated with prolonged storage of the heat recoverable coupling that must be kept in liquid nitrogen after deformation.

In our co-pending and commonly assigned U.S. application "Heat Treating Method," Ser. No. 550,847, also filed on even date herewith, as a C.I.P. of application Ser. No. 417,067, filed Nov. 19, 1973, the disclosures of both of which are incorporated by reference, we have described a method by which the $A_s$ of certain metallic compositions can be raised for one heating cycle. This method comprises first lowering the temperature of the composition from that at which it exists in the austenitic state to below its $M_f$ temperature. Then the composition is heated to a temperature at which normally it would exist wholly in the austenitic state, i.e., above the $A_f$ temperature. However, the transformation from martensite to austenite does not occur if the heating rate selected is a "slow" one. The definition of a "slow" heating rate is fully set forth in said co-pending application. Suffice it to say that it can vary depending upon the nature of the metallic composition but is easily determined by one skilled in the art having the benefit of said application.

If the composition is cooled after slow heating is complete and subsequently reheated at a rapid rate, it does not begin to undergo a martensite to austenite transformation until the approximate temperature at which slow heating was terminated is reached. More importantly, if an article was made from the composition and deformed while in the martensite state either prior to, or after, slow heating is terminated, it will not begin to undergo recovery to the form in which it existed in the austenitic state until it reaches approximately the temperature at which slow heating was suspended. We refer to this process as "thermal preconditioning."

In another co-pending U.S. application, "Mechanical Preconditioning Method," Ser. No. 550,555 filed on even date herewith and now U.S. Pat. No. 4,036,669, the disclosure of which is incorporated by reference, we have described yet another method by which the $A_s$ temperature of metallic compositions can be elevated. That method comprises holding the composition in a deformed configuration at a temperature above its normal $A_s$–$A_f$ range for a length of time sufficient to cause a portion of the deformation to be retained when the constraint is removed. The amount of deformation retained is a function of the temperature at which the composition is held and the duration of the holding step.

The composition can be deformed while in the austenitic state. Typically, however, this requires a great deal of force. Accordingly, it is preferred to deform the composition while it is in a more workable condition that occurs near, within or below the $M_s$–$M_f$ range and then to raise its temperature while restrained to the desired holding temperature.

By analogy to "thermal preconditioning, " this method is referred to as "mechanical preconditioning." An article preconditioned in this way when heated at a fast rate will recover a portion of the retained strain.

As a result of our discoveries, it has been possible to prepare heat recoverable articles having an elevated $A_s$ temperature. Frequently, however, metallic compositions which have been transformed into the martensitic state exhibit a tendency to lose all or a portion of their ability to revert back to austenite when heated through the $A_s$–$A_f$ range. In other instances, metallic compositions do not favorably respond to either thermal or mechanical preconditioning procedures for elevating the $A_s$ temperature. Obviously, it would be of great advantage to have available a method of inhibiting the loss of these desirable properties.

Accordingly, it is an object of this invention to provide a method by which the loss of martensite-austenite reversibility in metallic compositions is inhibited. It is yet another object to provide a method by which metallic compositions can be rendered more responsive to methods of imparting an elevated $A_s$ temperature. Yet another object of this invention is to provide metallic compositions having a reduced tendency to lose martensite-austenite reversibility and more responses to methods of imparting an elevated $A_s$.

SUMMARY OF THE INVENTION

The present invention provides a method by which the aforementioned objects can be achieved. The method comprises holding the article at a temperature at which it exists in the austenitic state, prior to transforming it into the martensitic state from which reversion to the austenitic state is desired, with or without preconditioning to raise its $A_s$, for a time sufficient to inhibit at least a portion of the loss of reversibility which otherwise may occur and/or improve its ability to be preconditioned. The holding period necessary to achieve these ends is dependent upon the composition and the holding temperature. Normally, the required holding period decreases as the temperature increases. The method of the invention can be referred to as "aging" and compositions so treated as "aged."

BRIEF DESCRIPTION OF THE DRAWINGS

FIGS. I*a* and I*b* show the effect of aging on alloys comprising copper, zinc and silicon that are thermally preconditioned.

FIG. 3 is a graph of resistivity-v-temperature such that a line joining the points $M_s$, $M_f$, $A_s$, $A_f$, and back to $M_s$ forms a loop termed the hysterisis loop.

DETAILED DESCRIPTION OF THE INVENTION

Figure 1A:
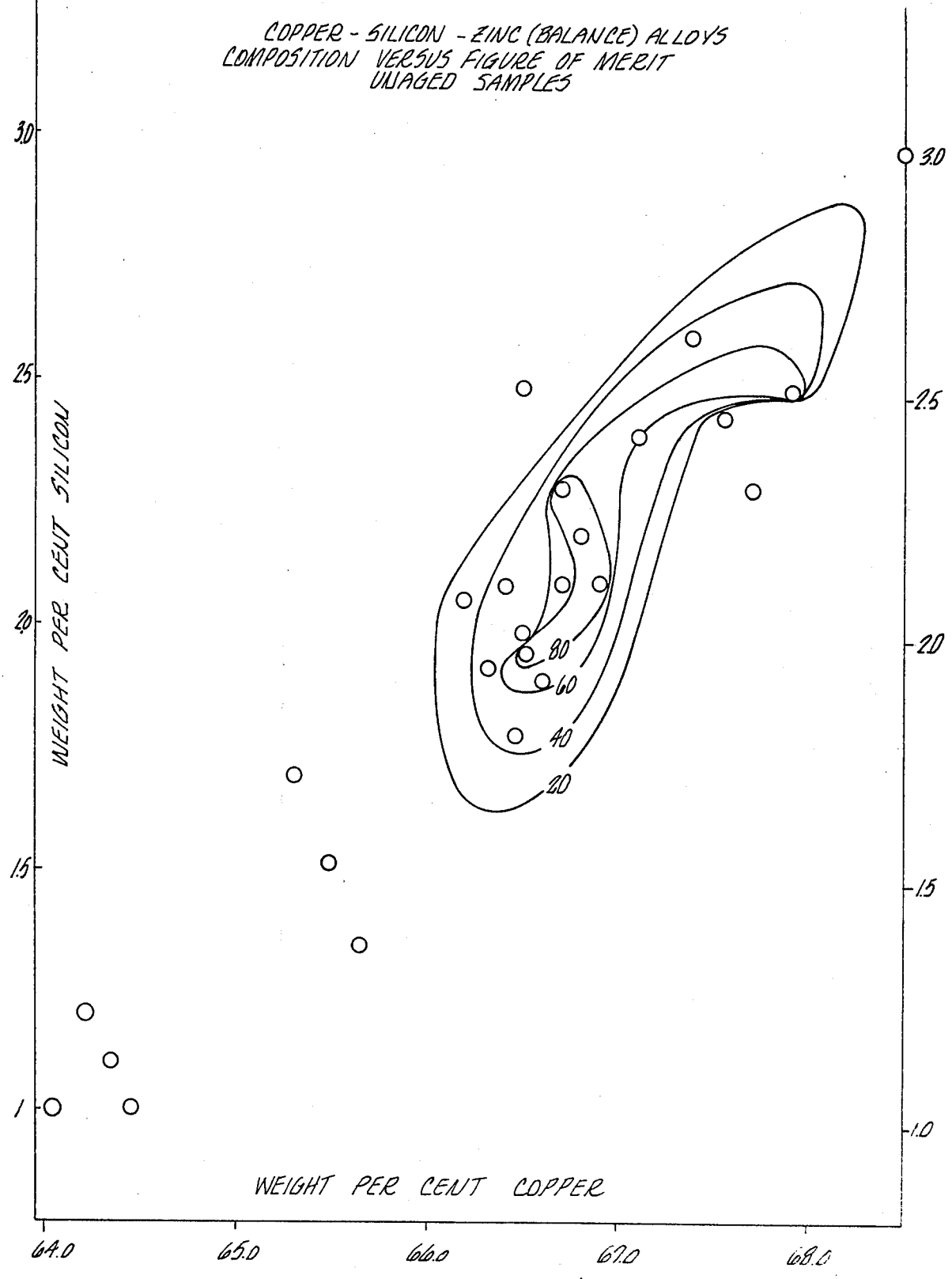

The present invention provides a method of inhibiting the loss of reversibility between the martensitic state and the austenitic state in those metallic compositions capable of undergoing reversible transformations between the martensitic state and austenitic state with changes in temperature. When metallic compositions are subjected to the process of this invention, their pseudoelasticity, i.e., their ability to transform from the austenitic to martensitic state with attendant deformation when subject to stress and to revert to the austenitic state and recover their original shape is improved.

The loss of reversibility referred to above manifests itself in several ways. In some cases, a sample of a metallic composition that has been cooled to below $M_f$ fails to revert completely or in part to austenite when allowed to warm through its normal $A_s$–$A_f$ range. Accordingly, any deformation that has been imparted to the sample while in the martensitic state may fail, at least in part, to recover when the sample is heated under conditions where recovery would be expected to occur.

In other cases, where even though the composition may undergo a reversible transformation to austenite after conversion to martensite followed by fast heating, the composition may not respond to either thermal or mechanical preconditioning when attempts are made to elevate its $A_s$. Because the reversibility is lost in the preconditioning process. We have found that the process of this invention can be employed to alleviate these conditions by maintaining the composition at a temperature at which it exists in the austenitic state for a time sufficient to inhibit, at least in part, the loss of reversibility referred to above. This process we refer to as "aging." Accordingly, this invention also provides "aged" alloys having a reduced tendency to lose reversibility between the martensitic and austenitic states. Such alloys are improved candidates for being rendered heat recoverable, apart from any attempt to elevate their $A_s$, and perform better after thermal and mechanical preconditioning.

In addition, the invention also provides a method of improving the response of certain alloys to mechanical or thermal preconditioning (that is increasing the amount of elevated heat recovery) by carefully controlling the aging to be within certain time and temperature limits, even though the total recovery may thereby be reduced. The optimum aging conditions can be found by routine experiment by those skilled in the art. Suffice it to say that in these compositions, as shown in the examples herein, too short an aging time or too low a temperature can give insufficient useful reversibility as mentioned hereinabove, and too long an aging time or too high a temperature can give insufficient useful elevated reversibility, even though the overall reversibility is improved in the latter instance.

The method of this invention is generally applicable to a wide variety of metallic compositions that undergo reversible austenite-martensite transformations. It is particularly suited to metallic compositions that are alloys, and more particularly, to alloys that form electron compounds. Compounds of these types are those disclosed in our hereinbefore referenced applications directed to thermal and mechanical preconditioning. Preferred electron compounds are those corresponding to the Hume-Rothery designation for structurally analogous body-centered cubic phases (e.g., beta-brass) or electron compounds that have ratios of about 3 valence electrons to 2 atoms. See *A.S.M. Metals Handbook,* Vol. 1, Eighth Ed. (1961) at p.4.

Among suitable alloys may be included $\beta$ phase alloys, for example, those typified by the copper-zinc and copper-aluminum alloys that form $\beta$ alloys of the body-centered cubic type associated with $\beta$-brass. Among these are those alloys of copper and zinc or copper and aluminum in which zinc and aluminum may at least partially replace each other and which themselves can be partially replaced by other alloying elements for example, silicon, tin, manganese or mixtures thereof. Alloys within this description are discussed in detail in our aforementioned co-pending applications disclosing the thermal and mechanical preconditioning processes. Preferred alloys include those comprised of from about 60–85 wt. % copper with varying amounts of zinc and/or aluminum in combination with silicon, manganese or mixtures thereof, for example, alloys having, 0 to about 40 wt. % zinc, 0 to about 5 wt. % silicon, 0 to about 14 wt. % aluminum and 0 to about 15 wt. % manganese that form body centered cubic type structures. Ternary and quaternary alloys of copper can be used. In the examples, a number of specific alloys that fall within these limits will be discussed in greater detail. However, it should be understood that the method of this invention may be applied beyond the limits of the preferred embodiments. For example, it is within the scope of this invention to apply the method of the present invention to alloys based on metals other than copper.

Alloys of this type are obtained in a $\beta$-phase by methods well known to the art. Usually the $\beta$-phase is obtained by rapidly quenching the alloy from an elevated temperature at which it exists in substantial part as a stable $\beta$-phase to a temperature at which it will exist as a meta stable $\beta$-phase. If the quenching rate is too slow, extensive amounts of a second phase may form which does not undergo the reversible austenite-martensite transformation. However, an alloy that is at least substantially in the $\beta$-phase, e.g., over 70% beta, may still possess to a substantial extent the same useful properties as the pure $\beta$-phase structure.

As indicated above, the method of this invention comprises holding the metallic composition at a temperature at which it exists in the austenitic state for a time sufficient to inhibit the loss of at least a portion of the reversibility between martensite and austenite. The most obvious benefit of this method is that it provides compositions that when deformed from a heat stable state to a heat unstable state recover a greater portion of the original strain.

The time required to inhibit the loss of reversibility can vary according to the composition and the holding temperature. Because the response to the aging process is affected by these variables, it is not possible to specify precise limits on time and temperature necessary to achieve best results with every composition. Nevertheless, optimum conditions are readily determined by those skilled in the art.

In the case of $\beta$-phase alloys, the aging temperature must be one at which there is no significant transformation of $\beta$-phase to a phase that undergoes no reversible austenite-martensite transformations.

For $\beta$-phase alloys of copper such as described above containing varying amounts of zinc, aluminum, silicon, manganese and combinations thereof, those having an $M_s$ below room temperature, aging at from about 50° to 125° C for a time ranging from about 5 minutes to 3 or 4 hours is usually adequate. Aging at higher or lower temperatures or for longer or shorter times can usually be beneficial, however. For other compositions, the time and temperature can vary but optimum results are readily determined by comparing the amount of reversal between martensite and austenite that occurs in representative samples, for example, by measuring the amount of strain recovered as a result of fast heating a sample.

The following examples illustrate the invention.

EXAMPLE 1

A series of experiments was conducted that compares the response of various compositions in the Cu-Zn-Si and Cu-Zn-Al -systems to the aging process of this invention and the effect on thermal preconditioning. Alloy samples were cast from melts having different ratios of copper, zinc, and either silicon or aluminum. The castings were hot-rolled into strips and cut into specimens about 37mm × 3mm × 0.75 mm. All specimens were heated until they entered the high-temperature, all-beta phase, then quenched into water. Half the samples were aged at 100° C for 10 minutes, the other half were not aged. All the samples were deformed by bending at −79° C to cause an outer fibre strain of 6%. After deformation, the samples were released and measured to determine how much strain was retained. Specimens from the aged and unaged groups were then heated according to one of the three following methods: (1) heated rapidly by immersion in liquid at 40° C, cooled to room temperature and measured to determine how much strain was recovered, then heated rapidly by immersion in liquid at 200° C and again returned to room temperature to determine how much additional recovery of strain occurred; (2) slowly heated at a rate of 0.25° C per minute from −79° to +40° C, cooled to room temperature, measured to determine how much strain was recovered, then heated rapidly by immersion in liquid at 200° C, cooled to room temperature and measured to determine how much additional recovery occurred; or (3) treated as (2), except that the slow heating rate was 1° C per 24 minutes, instead of 0.25° C per minute.

A "figure of merit" for the responsiveness of each composition tested to control of the recovery temperature range is obtained by expressing as a percent the recovery occurring above 40° C for slowly-heated specimens, less the recovery above 40 ° C for rapidly-heated specimens, divided by 5% (which is the ideal recovery after the elastic springback which accompanies release of the bending stress) i.e., $$\text{Figure of Merit} = 100 \times \frac{\text{recovery above 40° C in slowly heated specimens} - \text{recovery above 40° C in rapidly heated specimens}}{5}$$

Compositions found especially suitable for use in the invention will now be described in greater detail with reference to the drawings.

Figure 1B:
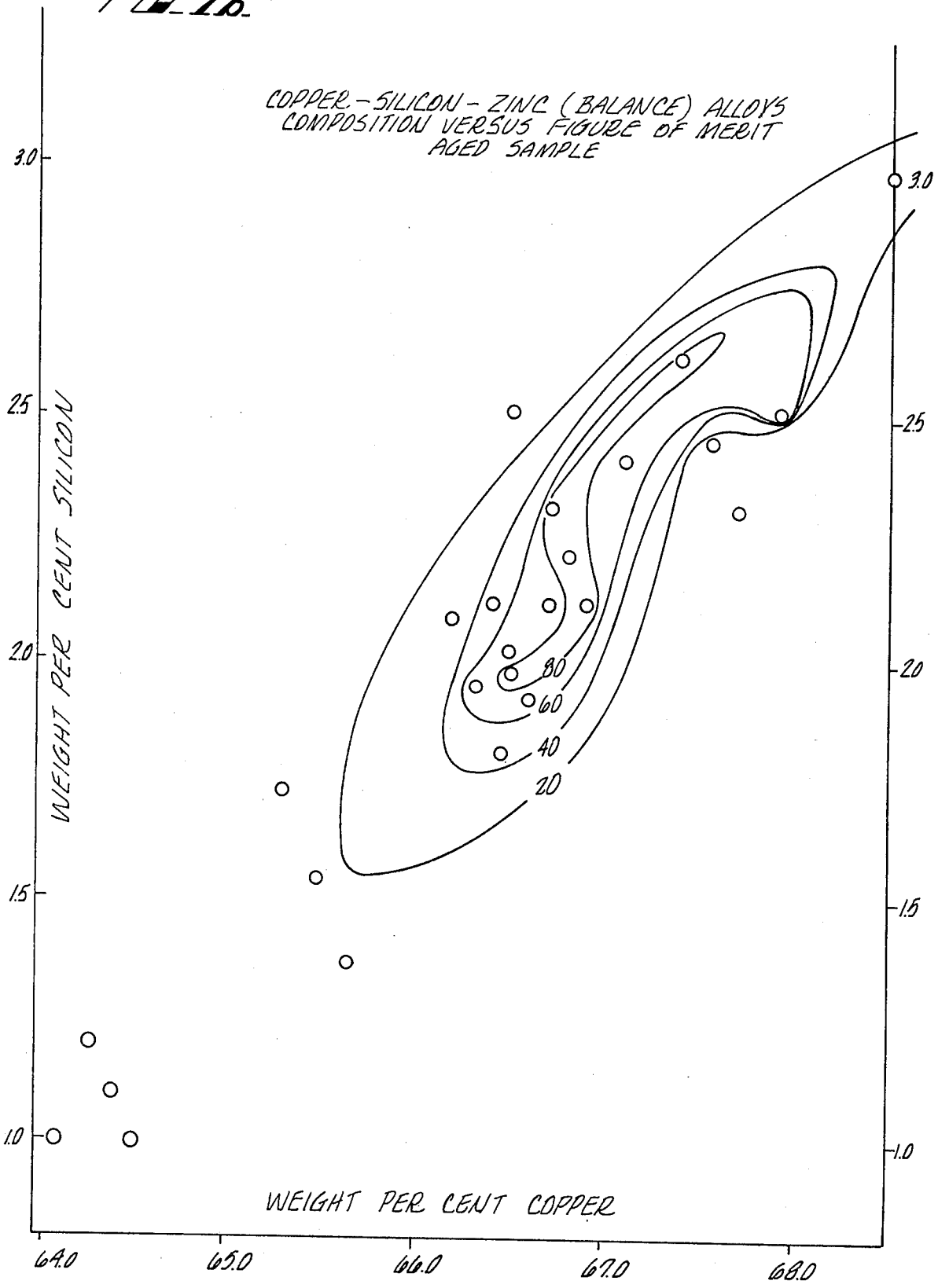

Referring now to FIGS. 1*a* and 1*b*, the figure-of-merit is plotted versus composition in FIGS. 1*a* and 1*b* in a topographical format. Generally, the long axes of the zones of constant figure-of-merit are parallel to iso-transformation temperature contours. Compositions with lower transformation temperatures are in the upper left while those with higher transformation temperatures are in the lower right of the figure. A distinct optimum appears in FIG. 1 in the range 1.8 to 2.7 Si, 66.2 to 67.5 Cu, balance Zn (29.8 - 32.0%). Comparison of FIG. 1*a* with 1*b* shows that aging 10 minutes at 100° C broadens the optimum from the same general centre point. The arbitrary selection of 40° C as the end of slow heating apparently disqualifies alloys whose usual transformation range lies above or partially above +40° C, those in the lower right portion of the figure, but it will be appreciated that a zero on the graph does not indicate unsuitability of these alloys for use in the invention, merely that a temperature of other than +40° C should be chosen as the preconditioning temperature. Similarly, for those alloys in the upper left portion of the figure, a zero on the graph does not necessarily mean that they are not responsive to the process of the invention. In these cases, a zero merely means that the rate of slow heating selected was not one that prevented recovery prior to reaching 40° C. However, those alloys with Figures-of-Merit above zero must be regarded as having responded to the slow heating treatment and slow heating at a different rate may give better results. The choice of 40° C causes the iso-figure-of-merit zone to close toward the high transformation temperature side (lower right). Alloys in the lower right region are responsive to the slow heating process, as the CuZnAl data below indicate.

Figure 2A:
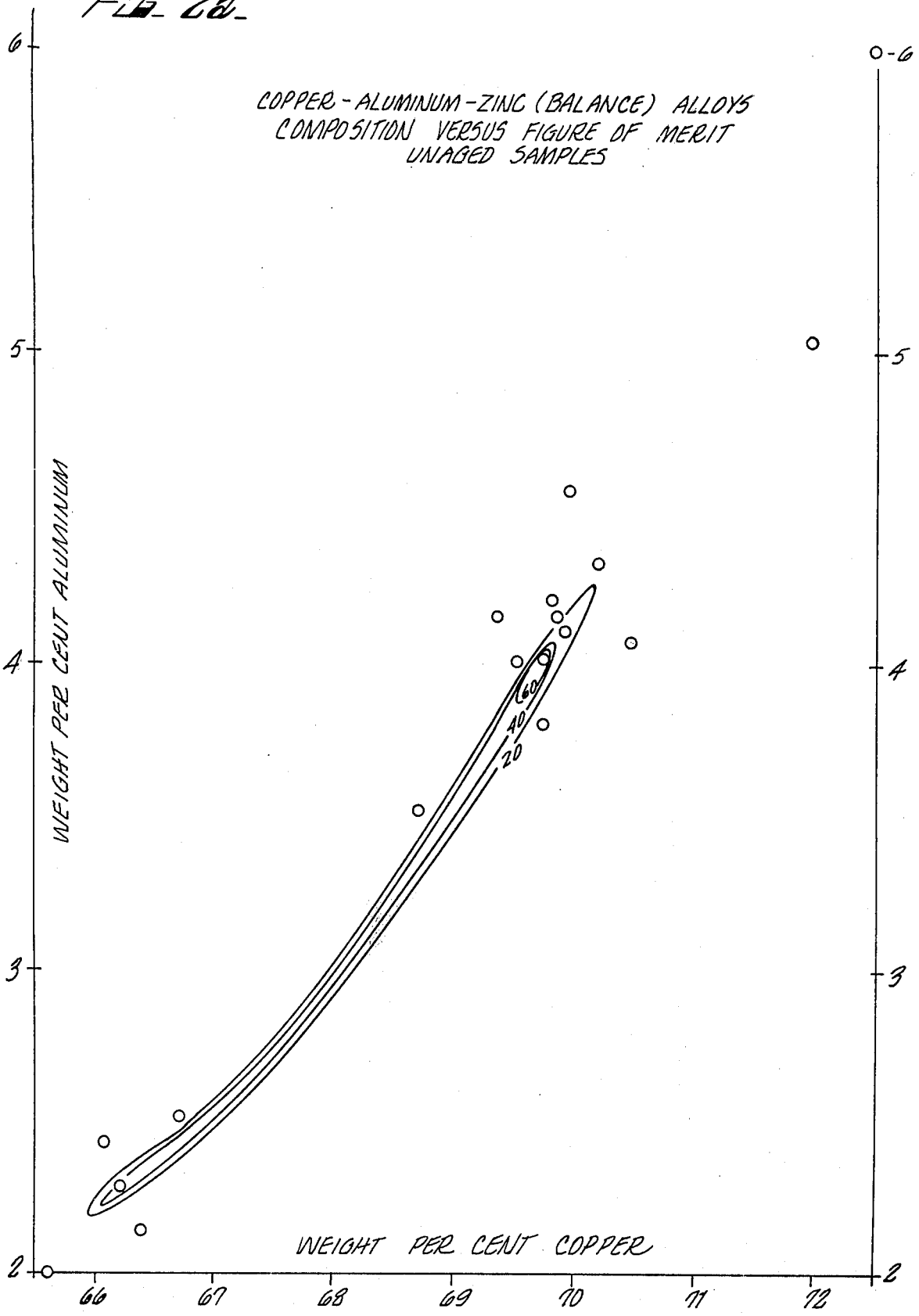
FIGS. 2*a*, 2*b*, 2*c* show the effect of aging on alloys comprising copper, aluminum and zinc that are thermally preconditioned.
Figure 2B:
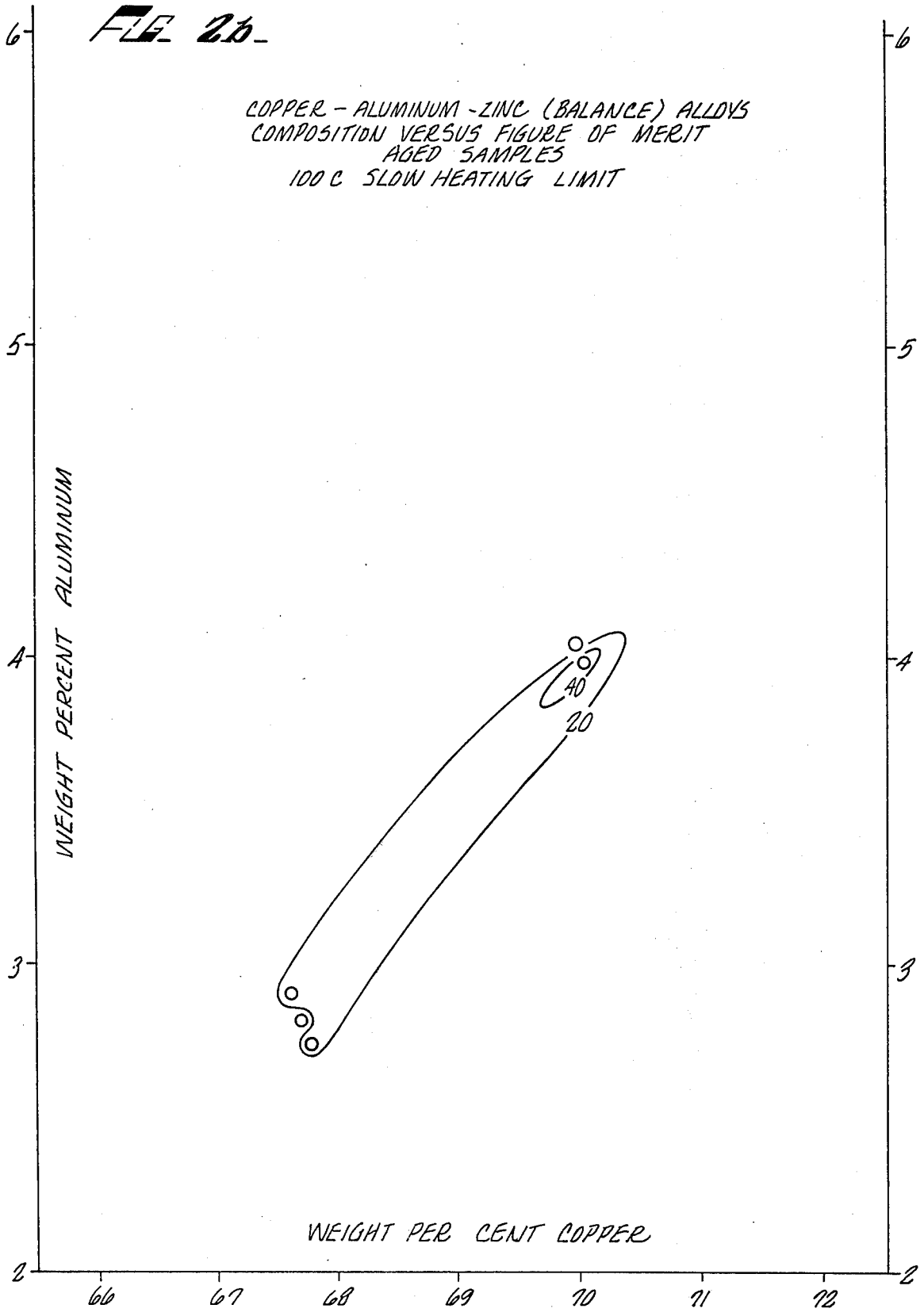
Figure 2C:
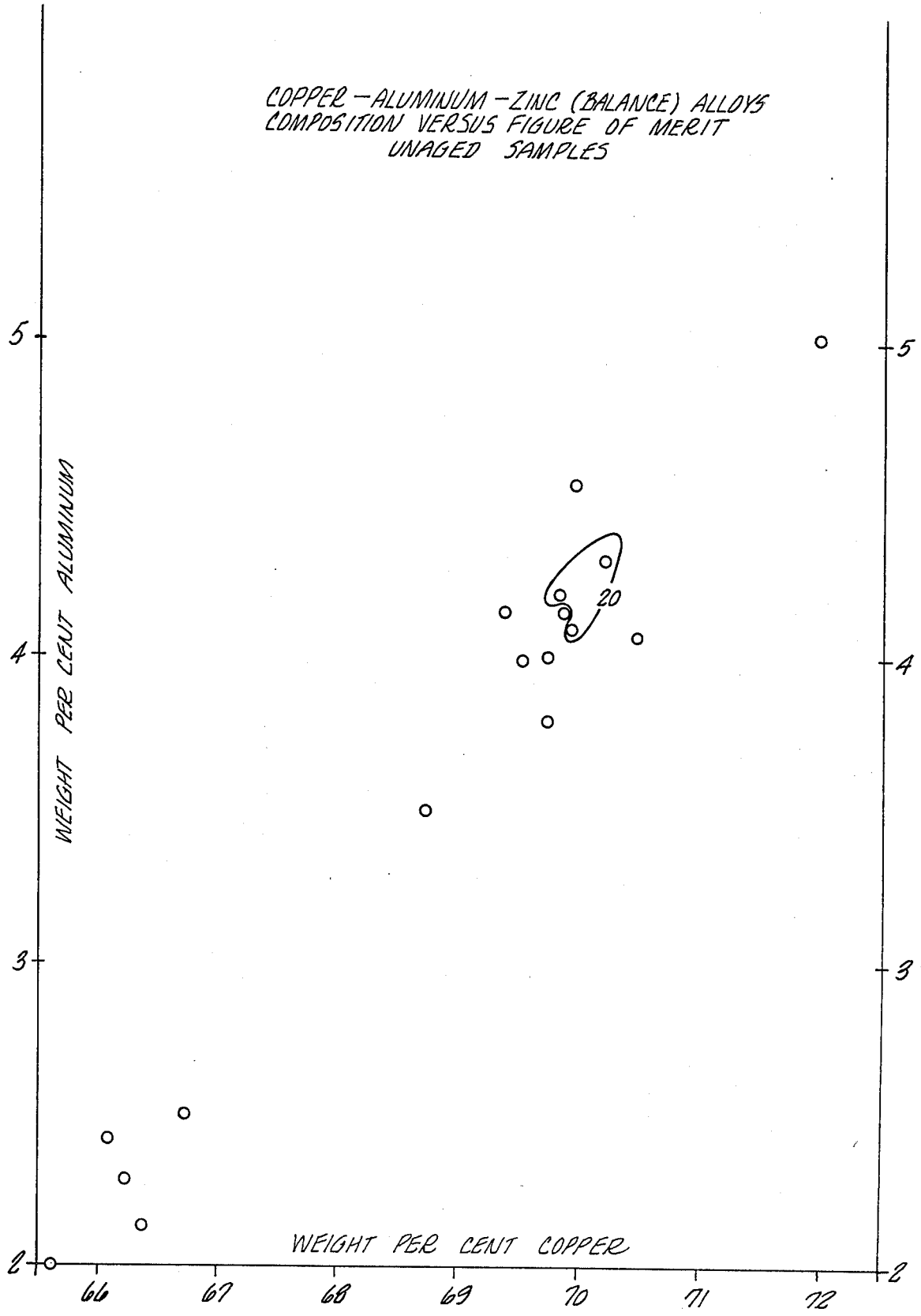

A topographical presentation of the figure-of-merit results for the CuZnAl system appears in FIG. 2. Again, the constant figure-of-merit zones lie parallel to the iso-transformation contours. A more distinct optimum region was defined by the unaged samples, FIG. 2*a* than for the aged, FIG. 2*b*.

Five alloy compositions having a normal $A_s$ at or above 40° C were used to test the mobility of the recovery range at higher temperatures. Again, the same general test procedure was used, but slow heating was continued to +100° C rather than stopping at +40° C. Results for aged samples appear in FIG. 2*c;* the new optimum lies parallel to that in FIG. 2*b*, but shifted as would be expected toward compositions with higher transformation temperatures. Although the recovery range is mobile in CuZnAl, the mobility seems more limited than in CuZnSi.

As the unaged CuZnAl samples lost their memory properties as a consequence of slow heating to 100° C, but the aged samples did not, it is apparent that the aging treatment is successful in preserving recoverability of the transformation in the higher temperature range.

It will be appreciated that the aging periods and conditions selected for FIGS. 1*b* and 2*b* result in certain compositions having optimum properties and that other aging periods and conditions result in different compositions having the same or broadly similar optimum properties. The aged alloys within the areas bounded by lines 40, 60 and 80 in FIG. 1*b* and line 20 in FIG. 2*b* are especially suited for the process of the invention.

EXAMPLE 2

Several specimens of an alloy of composition, by weight, of 64.5% copper, 34.5% zinc, 1.0% silicon were quenched after 5 minutes at 860° C into water at 20° C, and then aged at 50° C for times up to 1 week. After cooling to below $M_f$ the specimens were reheated at a rate of 10° to 20° C/minute. Little transformation of martensite to $\beta$-phase (as measured by changes in resistivity) occurred during heating of the specimen aged for 5 minutes. Some transformation took place in the specimen aged for 45 minutes; the specimens aged for 90 minutes or over transformed completely. Other specimens of the same alloy were given the same heat treatment and after aging were deformed in tension 8% at −50° C and reheated. The amount of heat-recovery was approximately proportional to the amount of martensite which had transformed in the resistivity tests on undeformed specimens. Hence, using the process of the invention by aging at least 45 minutes allowed permanent heat-recoverable properties to be imparted to this alloy.

After aging 5 minutes at 20° C before cooling to −50° C, the heat recoverable strain was 2.30%. After 45 minutes, at +50° C before cooling to −50° C, the heat recoverable strain was 6.20%. This slowly increased after longer aging times to 6.50% after 3 hours and 7.0% after 1 week.

EXAMPLE 3

Several samples of an alloy of composition by weight of 66.50% copper, 31.75% zinc and 1.75% silicon were also quenched after 5 minutes at 860° C into water at 20° C. They were then aged at 50° C for various times up to 1 week and deformed 8% at −50° C. After 4 minutes at 20° C, (the minimally aged sample) the heat recoverable strain was 0.1%. After 45 minutes at 50° C, this remained at 0.1% and after 90 minutes had only increased to 0.55%. Three hours increased the heat recovery strain to 0.70%, 1 day to 1.0% and 2 days to 3.9%. Thus, the increased silicon content can be seen to require much longer aging time to produce improved recovery.

EXAMPLE 4

Sixteen samples of 80.8 wt. % Cu, 10.5 wt. % Al, 8.7 wt. % Mn were betatized at 800° or 900° C for 3 minutes or 6 minutes, then quenched into room temperature water. Half the samples were aged for 10 minutes at 100° C, the others were not aged. All samples were deformed by bending at −79° C to give an outer fibre strain of 6%, then the stress was relaxed. Half the samples were heated to 100° at 0.25° C per minute, cooled to room temperature, then heated rapidly to 200° C.

The other half were heated rapidly to 100° C, cooled to room temperature, then heated rapidly to 200° C. The rate of rapid heating was greater than 100° C per minute. An analysis of the strain which was recovered during rapid heating to 200° C versus the controlled variables indicated that thermal preconditioning significantly increased the proportion of recovery taking place above 100° C. For this particular alloy, a statistical analysis indicated that aging had no effect.

Averaged Effects

Percent Strain Recovered Above 100° C
Fast heated: 0.39 percent
Preconditioned: 1.89 percent The experiment was repeated on an alloy containing 80.49 wt. % Cu, 10.5 wt. % Al, 9.01 wt. % Mn. Analysis of the strain which was recovered during rapid heating to 200° C versus the controlled variables showed significance for aging versus no aging and for non-preconditioned versus preconditioned.

Averaged Effects

Percent Strain Recovered Above 100° C
Un-aged 1.00
Fast Heated 0.15
Aged 0.36
Preconditioned 1.21

EXAMPLE 5

Samples of an alloy containing 79.2 wt. % Cu, 10.0 wt. % Al and 10.8 wt. % Mn were betatized at 550° C for 5 minutes and quenched into water at 20° C. The alloy had an $M_s$ of −20° C as a result of this treatment. Samples were either aged for 5 minutes or 1 hour at 50° C, then cooled to −30° C, or cooled to −30° C immediately after the water quenching without aging. All the samples were deformed 4% in tension at −30° and the stress released.

Half of the samples were immediately heated at a very rapid rate by immersion in liquids at 20°, 40°, 100° and 200° C. The incremental amount of strain recovered as a result of each immersion was recorded.

The remaining samples were initially slow heated at 6° C/minute to 40° C, after which they were recorded to −30° C and rapidly heated, as in the first set of samples. The results are shown in the table below.

TABLE I

| Result | Strain (%) | Aging Temp. (° C) | Aging Time | Heating Rate | Recovery by 40° C (% Strain) | Recovery Above 40° C (% Strain) |
|---|---|---|---|---|---|---|
| 1. | 3.8 | Unaged | | Rapid only | 1.4 | 2.1 |
| | | | | 6° C/min to 40° C, re- | 0 | — |
| 2. | 3.3 | Unaged | | cool & rapid heat | 0.3 | 1.2 |
| 3. | 3.2 | 50° C | 5 min | Rapid only | 3.1 | 0 |
| | | | | 6° C/min to 40° C, re- | 0.3 | — |
| 4. | 3.7 | 50° C | 5 min | cool and rapid heat | 0.3 | 2.8 |
| 5. | 3.6 | 50° C | 1 hr. | Rapid only | 3.35 | 0 |
| | | | | 6° C/min to 40° C, re- | 2.5 | — |
| 6. | 3.4 | 50° C | 1 hr. | | 0.3 | 0.1 |

Considering first those samples rapidly heated immediately after deformation, recovery was complete by 40° C in the samples aged 5 min. and 1 hr., but most recovery took place above 40° C in the unaged sample. In the samples initially heated at 6° C/min. to 40° C, no recovery took place by 40° C in this first heating cycle in the unaged samples and those samples aged 5 min. at 50° C. However, after recooling and rapid heating again, most recovery took place above 40° C. The sample aged 1 hr. at 50° C showed almost complete recovery in the initial heating cycle of 6° C/min. to 40° C.

These observations demonstrate that aging can lower the $A_s$ since in unaged samples significant recovery took place above 40° C without preconditioning (Compare Results 1, 3 and 5). However, the amount of heat recoverable strain obtained when a sample is thermally preconditioned is improved by aging. (Compare Results 2 and 4). Aging also affects the rate of slow heating necessary for thermal preconditioning. For a sample aged but 5 min. at 50° C, 6° C/min. was a "slow" heating rate as there was little recovery before 40° C. (See Result 4). However, in the case of a sample aged for 1 hour at 50° C, a heating rate of 6° C/min. qualified as a fast heating rate as most of the heat recoverable strain was recovered during the attempt to precondition. The combined effect of these results is to demonstrate that for a given alloy, there may be an optimum aging treatment, one, however, that is readily determined by those skilled in the art, prior to thermal preconditioning.

EXAMPLE 6

An alloy containing 64 wt. % copper, 35 wt. % zinc and 1 wt. % silicon was studied. This alloy has an $M_s$ temperature of −40° C.

Specimens were betatized for 5 minutes at 860° C quenched into water at 20° C, and then aged for different times in the metastable beta phase, which in this series of experiments was performed at 50° C. After insertion in the tensile loading device (approximately 5 minutes to set up at ambient temperature) the specimens were cooled to −65° C and deformed 8% in tension. After deformation, a constraint was applied to the tensile rig so that no contraction could take place, but the specimens were free to undergo a spontaneous expansion if one occurred. The constrained specimen was placed in water at +40° C, which provides a very fast heating rate and was held at that temperature for different times before re-cooling to below the $M_f$. Specimens came free of the constraint during cooling with a slight expansion compared with its original set after deformation. The constraint was removed from the apparatus so that specimens, now in their "preconditioned" state, could heat recover freely when reheated at a "fast" rate in a furnace set at 600° C.

The $A_s$ temperatures and heat-recoverable strains were measured as a function of the two main variables, aging time at 50° C before deformation and the time held under constraint at 40° C.

Results of "mechanical preconditioning" are shown in Table 1. For each aging time at 50° C some specimens have also been fast heated directly after deformation at −65° C, in order to compare the effect of "mechanical preconditioning" on the $A_s$ temperature.

Table II shows clearly the trend that the second $A_s$ temperature, the one induced by mechanical preconditioning, was raised as the holding time at 40° C was increased and in many cases exceeded the temperature of 40° C. On the other hand, the total heat-recoverable strain (i.e. 1st $A_s$ to $A_f$) was reduced with increased holding time at 40° C, and this loss in recovery occurred mainly in that portion of heat-recoverable strain between the second $A_s$ and $A_f$. Increasing the aging time at 50° C, in the metastable beta phase greatly improved the overall heat-recoverable strains but had only a slight effect in reducing the second $A_s$ temperature.

TABLE II

| Aging Time | Pre-cond. Holding Time at 40° C | Strain Per cent | $A_s$ Temp. °C 1st | $A_s$ Temp. °C 2nd | Recovery above 2nd $A_s$ per cent strain | Total Recovery per cent strain |
|---|---|---|---|---|---|---|
| | No Precond. | 7.05 | −50 | — | — | 6.50 |
| 5 mins | 10 secs | 6.90 | −43 | −4 | 5.65 | 6.80 |
| at R.T. | 30 secs | 7.10 | −37 | 31 | 4.15 | 5.65 |
| | 1 min. | 6.90 | −40 | 19 | 4.80 | 5.90 |
| | 5 min. | 7.65 | −37 | 59 | 2.90 | 3.95 |
| | 10 min. | 6.95 | −17 | 23 | 2.80 | 3.55 |
| | 1 hr. | 7.10 | −45 | 19 | 3.10 | 4.00 |
| | No Precond. | 7.25 | −33 | — | — | 6.95 |
| 45 mins | 10 secs | 6.75 | −49 | −9 | 5.30 | 6.55 |
| at 50° C | 30 secs | 6.35 | −52 | 4 | 4.40 | 5.85 |
| | 1 min. | 7.10 | −43 | 23 | 4.45 | 5.70 |
| | 5 min. | 7.35 | −40 | 20 | 5.60 | 7.00 |
| | 10 min. | 7.20 | −51 | 19 | 3.65 | 5.15 |
| | 1 hr. | 7.55 | −44 | 54 | 2.65 | 4.20 |
| | No Precond. | 7.00 | −32 | — | — | 6.75 |
| 3 hrs. | 10 secs | 7.25 | −41 | −4 | 5.75 | 7.00 |
| at 50° C | 30 secs | 7.20 | −32 | 15 | 4.15 | 5.65 |
| | 1 min. | 7.05 | −30 | 19 | 5.65 | 6.85 |
| | 5 min. | 6.85 | −47 | 13 | 4.80 | 6.20 |
| | 10 min. | 7.20 | −32 | 29 | 5.65 | 6.65 |
| | 1 hr. | 7.30 | −37 | 38 | 4.15 | 5.25 |
| | 5 hrs. | 7.15 | −44 | 44 | 5.60 | 6.75 |
| | 16 hrs. | 7.50 | −39 | 80 | 3.75 | 5.25 |
| | No Precond. | 7.20 | −27 | — | — | 6.70 |
| 24 hrs. | 10 secs | 7.05 | −37 | −4 | 5.85 | 6.55 |
| at 50° C | 30 secs | 7.25 | −42 | −5 | 5.80 | 7.25 |
| | 1 min. | 7.45 | −43 | 0 | 5.70 | 6.95 |
| | 5 min. | 7.50 | −35 | 24 | 5.75 | 6.70 |
| | 10 min. | 7.50 | −42 | 35 | 5.85 | 7.25 |
| | 1 hr. | 7.80 | −34 | 29 | 4.70 | 5.80 |
| | 5 hrs. | 7.40 | −34 | 35 | 5.05 | 5.95 |
| | 16 hrs. | 7.15 | −47 | 69 | 2.90 | 4.70 |
| | No Precond. | 7.10 | −33 | — | — | 6.80 |
| 1 wk | 10 min. | 7.00 | −28 | 33 | 5.60 | 6.45 |
| at 50° C | 1 hr. | 7.25 | −37 | 47 | 5.20 | 6.20 |
| | 5 hrs. | 7.45 | −37 | 40 | 5.15 | 6.70 |
| | 16 hrs. | 7.55 | −' | 33 | 5.60 | 6.70 |

We claim:

1. A metallic composition having a substantially reduced tendency to lose reversibility between its martensitic and austenitic state as compared with its normal tendency to do so at a given temperature.

2. An alloy comprising copper and a metal selected from a group consisting of zinc and aluminum, said alloy having a substantially reduced tendency to lose reversibility between its martensitic and austenitic state as compared with its normal tendency to do so at a given temperature.

3. The alloy of claim 2 wherein said metal is zinc.

4. The alloy of claim 3 and wherein said alloy contains a third metal selected from the group consisting of aluminum, manganese, silicon and tin.

5. The alloy of claim 4 wherein said third metal is silicon.

6. The alloy of claim 4 wherein said third metal is aluminum.

7. The alloy of claim 4 wherein the third metal is manganese.

8. The alloy of claim 2 wherein said metal is aluminum.

9. The alloy of claim 7 wherein said alloy contains a third metal selected from a group consisting of manganese, silicon, tin and zinc.

10. The alloy of claim 2 comprising 60-85 wt. % copper, 0 to about 40 wt. % zinc, 0 to about 5 wt. % silicon, 0 to about 14 wt. % aluminum and 0 to about 15 wt. % manganese.

11. A method of inhibiting loss of reversibility between the martensitic and austenitic states in a metallic composition comprising holding said composition at a temperature above the $M_s$ temperature while in the austenitic state for a time sufficient to reduce said loss, said holding temperature being one at which there is no significant transformation of the metallic composition to a phase that undergoes no reversible austenite-martensite transformation.

12. The process of claim 10 wherein, prior to said holding step, said composition is heated to a temperature substantially above room temperature and is then quenched.

13. The process of claim 11 wherein said quenching elevated temperature is a temperature at which the composition is at least substantially wholly in the austenitic state.

14. A method according to claim 11 wherein the $M_s$ temperature of the composition is below room temperature and the holding temperature is from about 50° to 125° C.

15. A method according to claim 14 wherein the holding time is from about 5 minutes to about 4 hours.

16. An alloy comprising copper and a metal selected from the group consisting of zinc and aluminum having a substantially reduced tendency to lose reversibility between its martensitic and austenitic state, said alloy being the product of the process comprising holding said composition at a temperature above the $M_s$ temperature while in the austenitic state for a time sufficient to reduce said tendency to lose reversibility, said holding temperature being one at which there is no significant transformation of the alloy to a phase that undergoes no reversible austenite-martensite transformation.

17. An alloy according to claim 16 wherein during said holding, the alloy is substantially free of externally applied stress.

18. The alloy of claim 17 wherein said metal is zinc.

19. The alloy of claim 18 wherein said alloy contains a third metal selected from the group consisting of aluminum, manganese, silicon and tin.

20. The alloy of claim 17 wherein said metal is aluminum.

21. The alloy of claim 20 wherein said alloy contains a third metal selected from the group consisting of manganese, silicon, tin and zinc.

22. The alloy of claim 17 comprising 60–85 wt. percent copper, 0 to about 40 wt. percent zinc, 0 to about 5 wt. percent silicon, 0 to about 14 wt. percent aluminum and 0 to about 15 wt. percent manganese.

* * * * *